United States Patent [19]

Speers et al.

[11] Patent Number: 4,522,160

[45] Date of Patent: Jun. 11, 1985

[54] FAN-SHROUD STRUCTURE

[75] Inventors: Leonard E. Speers; John D. Inhofer, both of Terre Haute; Philip D. Redenbarger, Centerpoint, all of Ind.

[73] Assignee: J. I. Case Company, Racine, Wis.

[21] Appl. No.: 572,738

[22] Filed: Jan. 23, 1984

[51] Int. Cl.[3] ..... F01P 5/06

[52] U.S. Cl. ..... 123/41.49; 165/135; 415/213 C

[58] Field of Search ..... 123/41.49; 165/51, 122, 165/135; 415/170 R, 174, 182, 196, 197, 213 C, 219 R

[56] References Cited

U.S. PATENT DOCUMENTS

| | | | |
|---|---|---|---|
| 2,668,523 | 2/1954 | Lamb | 123/41.49 |
| 3,937,189 | 2/1976 | Beck | 123/41.49 |
| 4,213,426 | 7/1980 | Longhouse | 123/41.49 |

FOREIGN PATENT DOCUMENTS

| | | | |
|---|---|---|---|
| 1126304 | 11/1956 | France | 123/41.49 |

*Primary Examiner*—William A. Cuchlinski, Jr.
*Attorney, Agent, or Firm*—Cullen, Sloman, Cantor, Grauer, Scott & Rutherford

[57] ABSTRACT

Fan-shroud structure and mounting which compensates for relative movement between an engine and radiator to prevent contact between a rotating fan and the shroud structure. In one embodiment of the invention, a one-piece fiberglass shroud is provided having a generally rectangular end portion which is integral with and merges into an opposed annular venturi portion. The rectangular end portion is secured to a bulbous seal which accommodates the relative movement between the engine and radiator to prevent damage to the shroud. In an alternate embodiment, a one-piece fiberglass venturi shroud is provided having a rounded convergent end section, a throat section and a divergent end section. A box-like outer shroud having an opening therein receives the convergent end section and a bulbous seal is fitted around the opening in the outer shroud for engagement with the throat section. The flexible bulbous seal which is interposed between the venturi shroud and the outer shroud accommodates the relative movement between the engine and radiator by yielding or flexing during such movement. Another embodiment of the fan-shroud structure includes a two-piece venturi shroud having separately formed sections of polyurethane and fiberglass. The flexible polyurethane section accommodates relative movement of the fiberglass section by flexing to prevent contact between the rotating fan and shroud structure. In the embodiments of the fan-shroud structure heretofore described, a relatively small clearance is maintained between the blade tips of the fan and the inner periphery of the shroud. However, an alternative embodiment of the fan-shroud structure includes a box section integrally formed with a rounded reverse venturi section that is flared inwardly into the box section. This fan-shroud is mounted to the radiator to provide a fairly large fan tip clearance thereby permitting substantial relative movement between the fan and the shroud.

4 Claims, 11 Drawing Figures

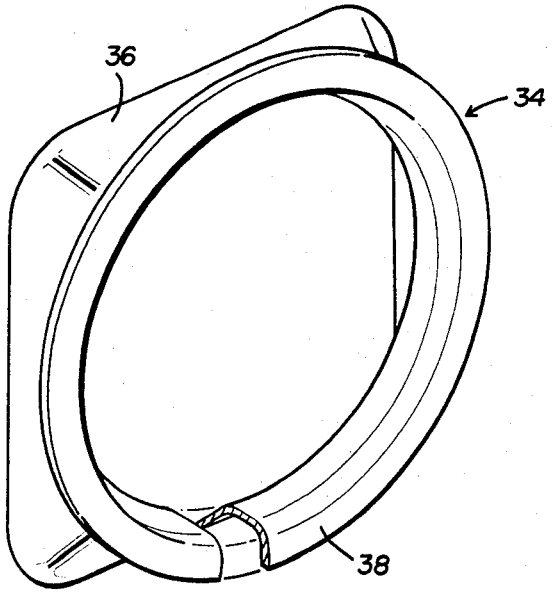
FIG. 1
FIG. 2
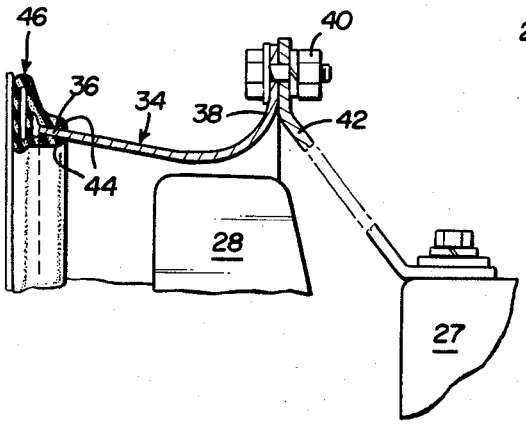
FIG. 3
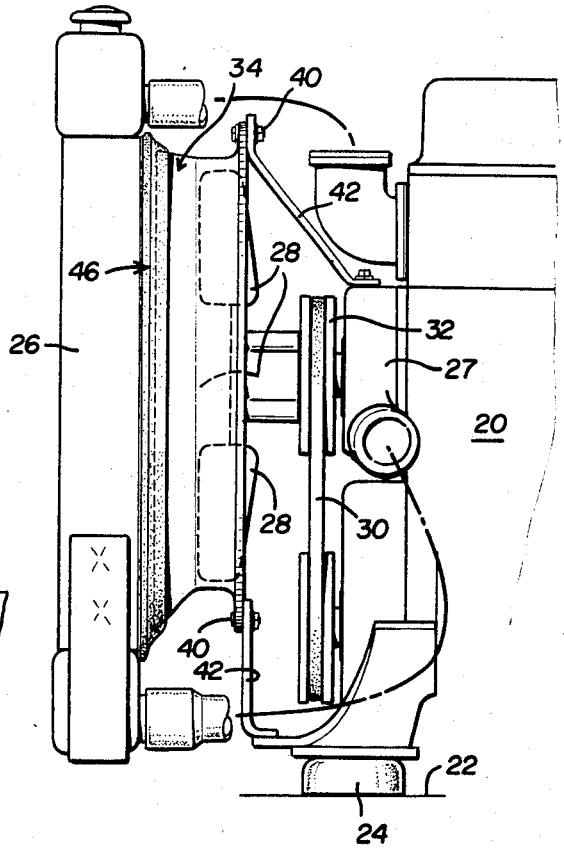

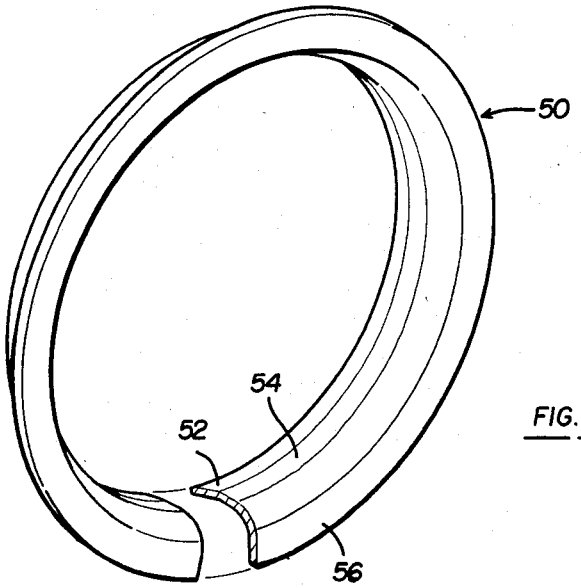
FIG. 6
FIG. 5
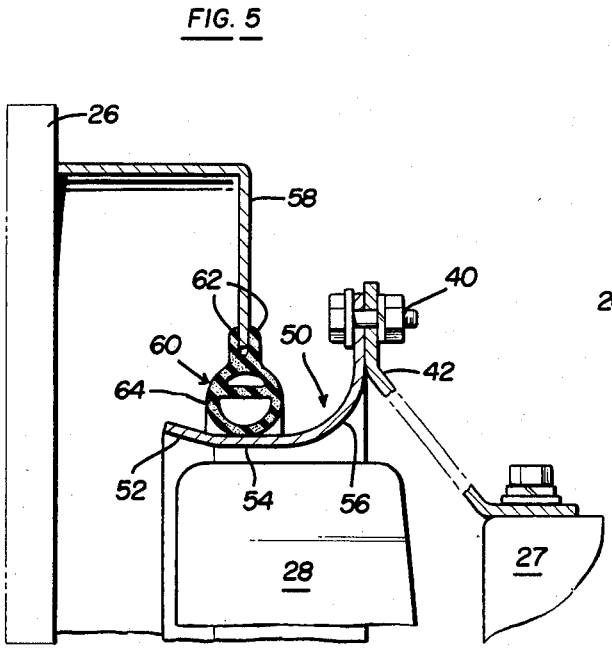
FIG. 4
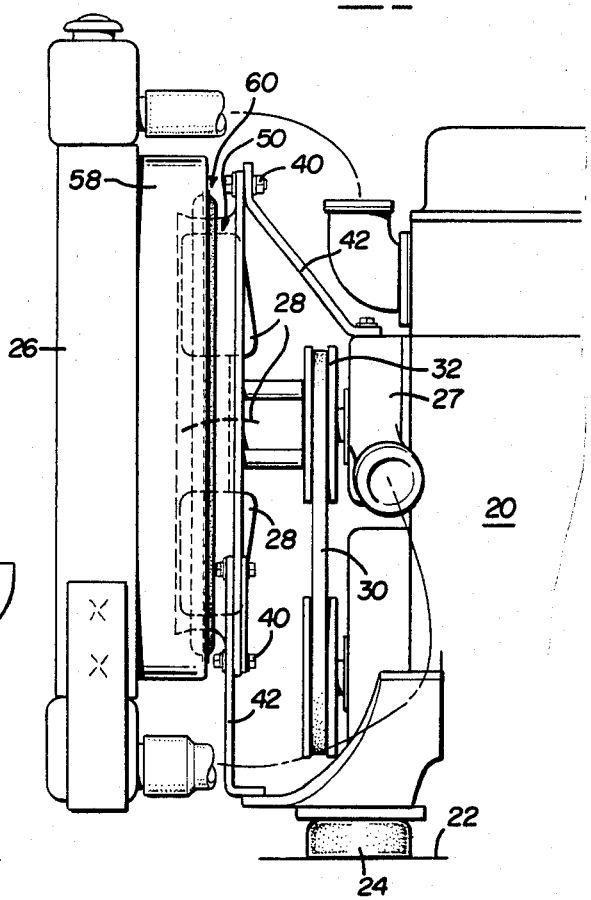

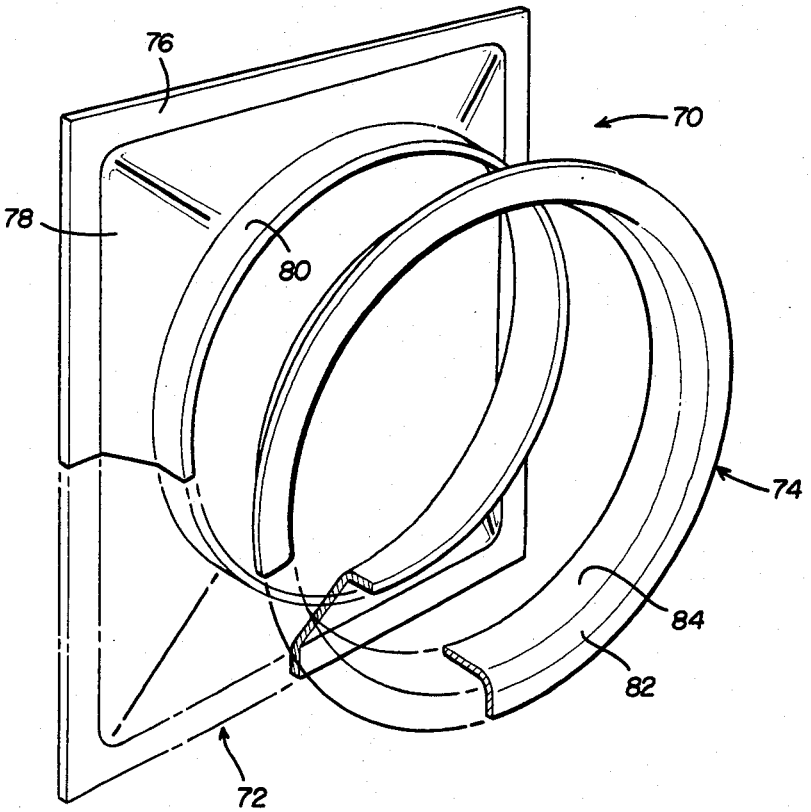
FIG. 9
FIG. 7
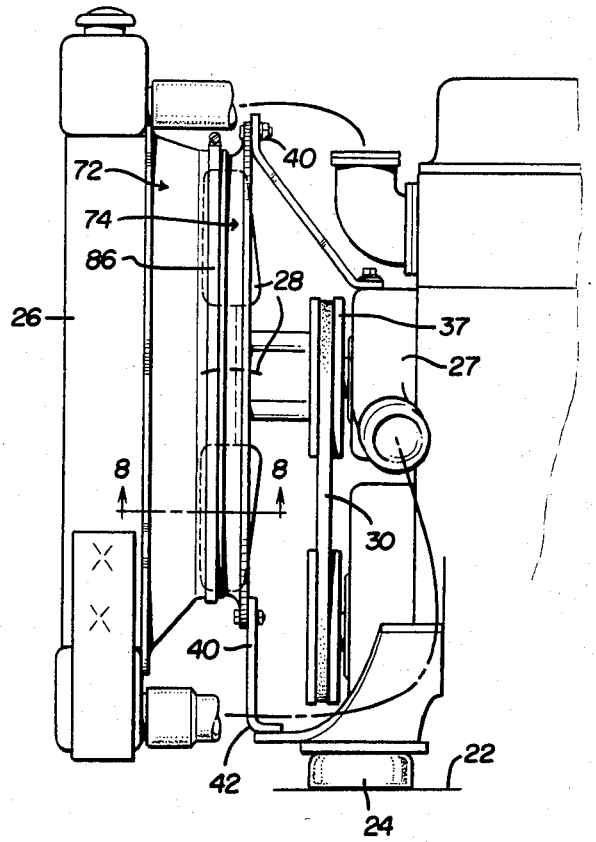
FIG. 8
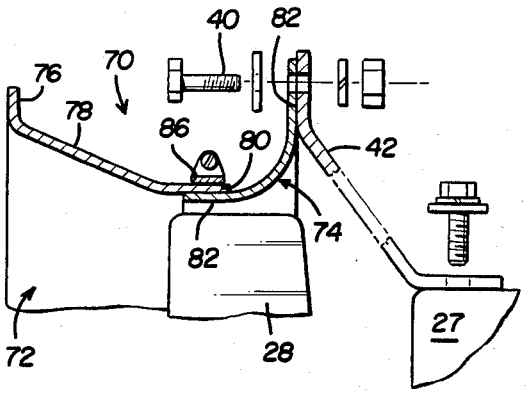

FAN-SHROUD STRUCTURE

BACKGROUND OF THE INVENTION

The present invention relates to fan shrouds and, more particularly, to improved shrouding for engine mounted cooling fans which permits relative movement between an engine and radiator while preventing contact between the rotating fan and shroud structure.

It is conventional to mount a shroud around a rotating engine mounted cooling fan which pushes air through a radiator for cooling the engine-heated liquid circulated therein. In such constructions, minimized clearance between the fan blade tips and the internal diameter of the shroud is desired to increase the cooling efficiency. However, with the cooling fan mounted on the engine, there is relative motion between the fan and the shroud since the fan moves with the engine when the engine rolls, shakes or vibrates. With such relative motion, it has been necessary to provide a clearance within the shroud which prevents contact between the fan and that part of the shroud wherein the fan rotates.

Accordingly, it is an object of the present invention to provide improved fan-shroud structure which prevents contact between the rotating fan and shroud while permitting sufficient clearance to be maintained between the blade tips of the fan and the inner periphery of the shroud, thereby maximizing cooling efficiency. A further object of the invention is to provide an improved fan-shroud structure and mounting which is simple and economical to manufacture.

SUMMARY OF THE INVENTION

In a first embodiment of this invention, a one-piece fiberglass shroud is provided including a generally rectangular base perimeter portion which is integral with and merges into an opposed annular bell-mounted venturi perimeter portion. The venturi perimeter portion is attached to an engine such that a small clearance is formed between the blade tips of a fan and the inner periphery of the venturi portion. The rectangular base perimeter portion is fitted between finger-like ring portions of a bulbous seal which is secured to a radiator.

Since the radiator is mounted separately from the engine, the engine and radiator can move independently relative to each other. To allow for engine roll, vertical shake or longitudinal vibrations which occur, the bulbous seal yields or flexes to prevent contact between the rotating fan and shroud. With this construction, a small clearance can be maintained between the blade tips of the fan and the inner periphery of the shroud to maximize cooling efficiency. Thus, the flexible bulbous seal which is secured between the generally rigid shroud and radiator will accommodate the relative movement between the engine and radiator to prevent damage to the shroud while maintaining a small clearance between the blade tips of the fan and shroud.

The unique construction for the shroud also permits easier installation and an increased flow of air into the fan. During installation, the generally rectangular base portion may be attached to the bulbous seal before attaching the venturi portion to the engine. The rectangular base portion prevents rotation of the shroud thereby permitting easier alignment and attachment. Further, the base portion permits an increased flow of air through the venturi portion for improving cooling efficiency.

A second embodiment for the fan-shroud structure includes a onepiece fiberglass venturi shroud having a rounded convergent end section, a throat section of constant diameter, and a divergent end section. In this construction, a box-like outer shroud is attached to the radiator. The outer shroud includes an opening therein for receiving the convergent end section of the venturi shroud. A bulbous seal is fitted around the opening in the outer shroud for engagement with the throat section of the venturi shroud. The bulbous seal includes finger-like ring portions for gripping the outer shroud and a large circular contact tube portion which engages the venturi throat section.

During operation, the generally rigid one-piece fiberglass venturi shroud will move with the engine relative to the radiator. The flexible bulbous seal which is interposed between the venturi shroud and outer shroud will accommodate the relative movement by yielding or flexing thereby preventing contact between the rotating fan and venturi shroud.

The third embodiment of the fan-shroud structure includes a twopiece venturi shroud having separately formed polyurethane and fiberglass sections. The polyurethane section includes a rectangular peripheral wall portion, a rounded convergent portion, and a throat portion of constant diameter. The fiberglass section includes a divergent end portion and a throat portion of constant diameter. The throat portions are positioned in overlapping relationship to one another and a continuous band clamp is fitted around the periphery thereof for securing the two sections together.

When the generally rigid fiberglass section moves with the engine relative to the radiator, the flexible polyurethane section accommodates the relative movement by yielding or flexing thereby preventing contact between the fan blades and fiberglass section.

In the embodiments of the fan-shroud structure heretofore described, a relatively small clearance is maintained between the blade tips of the fan and the inner periphery of the shroud. However, extensive testing has shown that for pusher fans, the close fan tip clearance does not appreciably raise the air-to-boil quotient for a given radiator nor is there any substantial reduction in the sound pressure level. Thus, an alternative embodiment of the fan-shroud structure has been developed which includes a box section integrally formed with a rounded reverse venturi section that is flared inwardly into the box section. This fan-shroud is mounted to the radiator to provide a fairly large fan tip clearance at the inner diameter of the venturi thereby permitting sufficient relative motion between the fan and the shroud when the fan rotates.

One of the advantages of this fan-shroud construction is expense because it can be vacuum formed in a one-piece mold. Further, this design is less susceptible to fatigue failure due to radiator vibration.

Other advantages and meritorious features of the fan-shroud structures of the present invention will be more fully understood from the following description of the preferred embodiments, the appended claims and the drawings, a brief description of which follows.

BRIEF DESCRIPTION OF DRAWINGS

FIG. 1 is a side elevational view of a first embodiment of the fan-shroud structure connected between an engine and radiator.

FIG. 2 is a partial cross-section of the fan-shroud shown in FIG. 1 which illustrates the bulbous seal.

FIG. 3 is a perspective view of the one-piece fiberglass shroud shown in FIG. 1.

FIG. 4 is a side elevational view of a second embodiment for the fan-shroud structure mounted between an engine and radiator.

FIG. 5 is a partial cross-sectional view of the fan-shroud structure shown in FIG. 4.

FIG. 6 is a perspective view of the venturi shroud shown in FIG. 5.

FIG. 7 is a side elevational view illustrating a third embodiment of the fan-shroud structure mounted between an engine and radiator.

FIG. 8 is a partial cross-sectional view of the two-piece venturi shroud structure shown in FIG. 7.

FIG. 9 is a perspective view of the two-piece venturi shroud shown in FIG. 8.

DETAILED DESCRIPTION OF THE PREFERRED EMBODIMENTS

Figure 10:
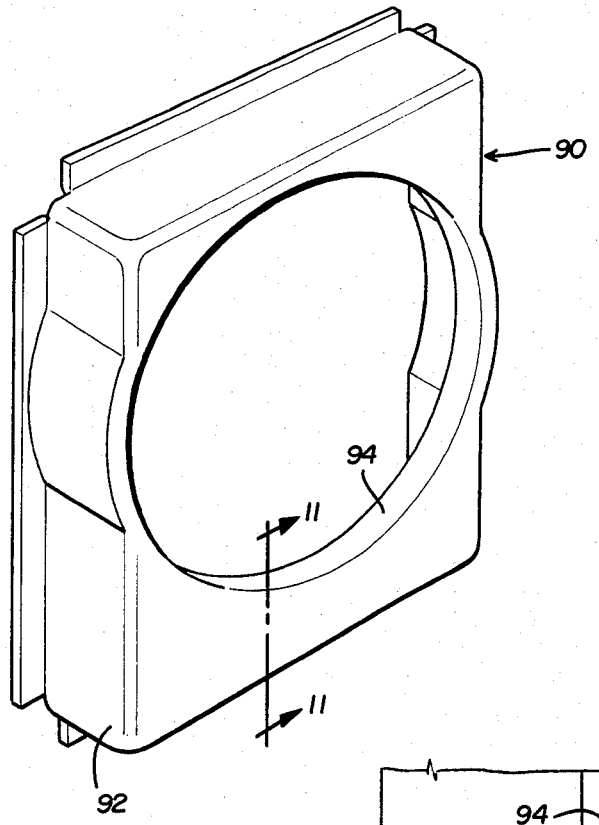
FIG. 10 is a perspective view of a one-piece shroud made in accordance with the teachings of the present invention.

Referring to the drawings, there is shown a liquid cooled internal combustion engine 20 resiliently mounted on vehicle frame 22 by elastomeric engine mounting blocks such as block 24. These engine mounting blocks dampen and isolate vibratory energy generated by the engine in powering a vehicle while permitting the engine to vibrate relative to fixed components in the engine compartment. A liquid cooling radiator 26 is connected by fluid lines to the engine and to a water pump 27 as is conventional to dissipate heat generated by the engine. Rotatably mounted at the forward end of the engine 20 is a multibladed cooling fan 28 which is engine driven through a conventional belt 30 and pulley 32.

FIGS. 1–3 illustrate a first embodiment of the fan-shroud structure of the present invention. Referring to FIG. 3, a one-piece fiberglass shroud 34 is provided including a generally rectangular base perimeter portion 36 which is integral with and merges into an opposed annular bell-mouthed venturi perimeter portion 38. The venturi perimeter portion 38 is attached by fasteners 40 to a plurality of brackets 42 on engine 20 such that a small clearance is formed between the blade tips of fan 28 and the inner periphery of venturi portion 38. The rectangular base perimeter portion 36 is fitted between fingerlike ring portions 44 of a complementary bulbous seal 46 which is secured to radiator 26.

Since radiator 26 is mounted separately from engine 20, the engine and radiator can move independently relative to each other. To allow for engine roll, vertical shake or longitudinal vibrations which occur, the generally rectangular bulbous seal 46 will yield or flex to prevent physical damage from occuring by the contact of the rotating fan 28 with shroud 34. With this construction, a small clearance can be maintained between the blade tips of fan 28 and the inner periphery of shroud 34 to maximize the cooling efficiency.

Thus, the generally rigid one-piece fiberglass shroud 34 and fan 28 will move with engine 20 relative to radiator 26 during operation. The flexible bulbous seal 46 which is secured between the generally rigid shroud 34 and radiator 26 will accommodate the relative movement involved to prevent damage to shroud 34 while maintaining a small clearance between the blade tips of fan 28 and shroud 34.

The unique construction for shroud 34 including the generally rectangular base perimeter portion 36 permits easier installation and an increased flow of air into fan 28. During installation, the generally rectangular base portion 36 may be attached to bulbous seal 46 before venturi portion 38 is connected to brackets 42. The rectangular end construction on shroud 34 prevents rotation of the shroud thereby permitting easier alignment and attachment to brackets 42. Further, the generally rectangular base portion 36 permits an increased flow of air through venturi portion 38 for improving cooling efficiency.

FIGS. 4–6 illustrate an alternate embodiment for the fan-shroud structure of the present invention. A one-piece fiberglass venturi shroud 50 is provided including a rounded convergent end section 52, a throat section 54 of constant diameter, and a divergent end section 56. Attached to radiator 26 is a box-like outer shroud 58 having an opening therein for receiving the convergent end section 54 of venturi shroud 50. A bulbous seal 60 is fitted around the opening in outer shroud 58 for engagement with the throat section 54. Bulbous seal 60 includes finger-like ring portions 62 for gripping the outer shroud 58 and a large circular contact tube portion 64 which engages venturi throat section 54. Venturi shroud 50 is attached by fasteners 40 to a plurality of brackets 42 on engine 20 such that a small clearance is formed between the blade tips of fan 28 and the inner periphery of shroud 50.

During operation, the generally rigid one-piece fiberglass venturi shroud 50 and fan 28 will move with engine 20 relative to radiator 26. The flexible bulbous seal 60 which is interposed between venturi shroud 50 and outer shroud 58 will accommodate the relative movement by yielding or flexing thereby preventing contact between rotating fan 28 and shroud 50 while maintaining a small clearance between the blade tips of fan 28 and shroud 50.

FIGS. 7–9 illustrate yet another embodiment of the fan-shroud structure of the present invention. A two-piece venturi shroud 70 is provided including separately formed sections 72 and 74. Section 72 is made of polyurethane and includes a rectangular peripheral wall portion 76, a rounded convergent portion 78 and a throat portion 80 of constant diameter. Section 74 is made of fiberglass and includes a divergent end portion 82 and a throat portion 84 of constant diameter. Section 74 is attached by fasteners 40 to brackets 42 on engine 20 and section 72 is attached to radiator 26.

The throat portions 80 and 84 of sections 72 and 74 are positioned in overlapping relationship to one another and a continuous band clamp 86 is fitted around the periphery thereof for securing sections 72 and 74 together.

During operation, the generally rigid fiberglass section 74 and fan 28 will move with engine 20 relative to radiator 26. The flexible polyurethane section 72 will accommodate the relative movement by yielding or flexing thereby preventing contact between the rotating fan 28 and shroud section 74.

In the embodiments of the fan-shroud structure heretofore described, a relatively small clearance is maintained between the blade tips of the fan and the inner periphery of the shroud. However, extensive testing has shown that for pusher fans, the close fan tip clearance does not appreciably raise the air-to-boil quotient for a given radiator nor is there any substantial reduction in the sound pressure level. Thus, an alternative embodiment of the fan-shroud structure is illustrated in FIGS. 10–11 which is easier to manufacture and is more durable than those constructions previously described.

Figure 11:
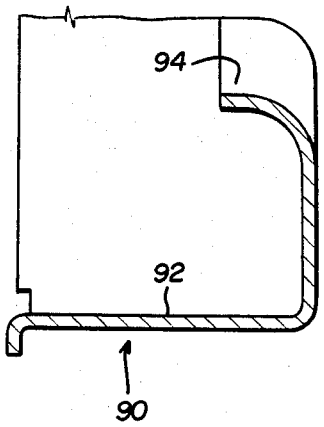
FIG. 11 is a cross-sectional view taken along line 11—11 in FIG. 10.

FIGS. 10–11 disclose a one-piece shroud 90 which includes a box section 92 that is integrally formed with a rounded reverse venturi section 94 that is flared inwardly into box section 92. Shroud 90 may be mounted directly between radiator 26 and brackets 42 because the venturi opening 100 is enlarged to provide sufficient fan blade tip clearance even if engine 20 moves relative to radiator 26. This construction lends itself to be vacuum formed from a one-piece mold, and therefore, the one-piece shroud 90 is less expensive and less susceptible to fatigue failure due to radiator vibration.

It will be apparent to those skilled in the art that the foregoing disclosure is exemplary in nature rather than limiting, the invention being limited only by the appended claims.

We claim:

1. A shroud structure for use with a radiator and liquid cooled internal combustion engine having a multi-bladed fan rotatably mounted on said engine intermediate said engine and said radiator, said engine and radiator being mounted for movement relative to each other, said shroud structure including:

a one-piece generally rigid fiberglass shroud having a generally rectangular base perimeter portion which is integral with and merges into an opposed annular bell-mouthed venturi perimeter portion;

said venturi perimeter portion surrounding said rotatable fan and being attached to said engine such that a small clearance is formed between the blades of said fan and the inner periphery of said venturi portion;

said rectangular base perimeter portion being fitted between a pair of finger-like gripping ring portions of a complementary generally rectangular bulbous flexible seal which is secured to said radiator, and said flexible bulbous seal accommodating the relative movement between said engine and radiator to prevent damage to said shroud structure from said rotatable fan.

2. A shroud structure for use with a radiator and liquid cooled internal combustion engine having a multi-blade fan rotatably mounted on said engine intermediate said engine and said radiator, said engine and radiator being mounted for movement relative to each other, said shroud structure including:

a one-piece fiberglass venturi shroud having a rounded convergent end section, a throat section of constant diameter, and a divergent end section;

a box-like outer shroud attached to said radiator, said outer shroud having an opening therein for receiving the convergent end section of said venturi shroud;

a bulbous seal fitted around the opening in said outer shroud for engagement with the throat section of said venturi shroud, said bulbous seal including finger-like ring portions for gripping said outer shroud and a large circular contact tube portion which engages said venturi throat section; and said venturi shroud surrounding said rotatable fan and being attached to said engine such that a small clearance is formed between the blades of said fan and the inner periphery of said shroud, and said bulbous seal being flexible to accommodate the relative movement between said engine and said radiator to thereby prevent damage from the contact of said rotatable fan with said venturi shroud.

3. A shroud structure for use with a radiator and liquid cooled internal combustion engine having a multi-bladed fan rotatably mounted on said engine intermediate said engine and said radiator, said engine and radiator being mounted for movement relative to each other, said shroud structure including:

a two-piece venturi shroud having separately formed sections including a first flexible polyurethane section and a second generally rigid fiberglass section;

said first section including a rectangular peripheral wall portion, a rounded convergent portion, ans a throat portion of constant diameter, and said rectangular peripheral wall portion being attached to said radiator;

said second section including a divergent end portion connected to said engine and a throat portion of constant diameter;

the throat portions of said first and second sections being positioned in overlapping relationship to one another and a continuous band clamp being fitted around the periphery thereof for securing said first and second sections together; and said generally rigid second fiberglass section surrounding said rotatable fan and moving with said engine relative to said radiator, and said flexible first polyurethane section accommodating the relative movement between said engine and radiator by flexing thereby preventing damage from contact between said rotatable fan and said second section.

4. A shroud structure for use with a radiator and liquid cooled internal combustion engine having a multi-bladed fan rotatably mounted on said engine intermediate said engine and said radiator, said engine and radiator being mounted for movement relative to each other, said shroud structure including:

a one-piece fiberglass shroud having a generally rectangular box-like portion which is attached at one end to said radiator and said box-like portion having an opposite end which is flat with an opening therein, a rounded venturi portion integrally formed with said box-like portion to form a surface surrounding said rotatable fan at said opening, and said rounded venturi portion only flaring inwardly into said box-like portion for providing sufficient fan blade clearance to prevent contact between said fan and said shroud when said engine moves relative to said radiator.

* * * * *